US010519689B1

(12) United States Patent
Madden, Jr.

(10) Patent No.: US 10,519,689 B1
(45) Date of Patent: Dec. 31, 2019

(54) ASSEMBLY FOR THE TOP OF A SECURITY WALL

(71) Applicant: James R. Madden, Jr., Mesa, AZ (US)

(72) Inventor: James R. Madden, Jr., Mesa, AZ (US)

( * ) Notice: Subject to any disclaimer, the term of this patent is extended or adjusted under 35 U.S.C. 154(b) by 0 days.

(21) Appl. No.: 16/501,980

(22) Filed: Jul. 15, 2019

Related U.S. Application Data

(63) Continuation-in-part of application No. 15/932,635, filed on Mar. 29, 2018.

(51) Int. Cl.
*E04H 17/00* (2006.01)
*E04F 19/02* (2006.01)

(52) U.S. Cl.
CPC ..... *E04H 17/003* (2013.01); *E04F 19/02* (2013.01)

(58) Field of Classification Search
CPC ..... E04H 17/003; E04F 19/02
See application file for complete search history.

(56) References Cited

U.S. PATENT DOCUMENTS 448,318 A * 3/1891 Chattanay
903,258 A * 11/1908 Woodson
5,310,163 A * 5/1994 Waite ..... E04H 17/00 256/11
9,334,671 B2 * 5/2016 Kelly ..... E04H 17/003
2009/0032788 A1 * 2/2009 Adler ..... E04H 17/00 256/11

* cited by examiner

*Primary Examiner* — Patrick J Maestri
(74) *Attorney, Agent, or Firm* — H. Gordon Shields

(57) ABSTRACT

A high security top element assembly for a security wall includes arcuate elements extending outwardly and downwardly from the top of a wall. The arcuate elements extend in both directions from the top of the wall. The arcuate elements terminate outwardly from the wall a sufficient distance to prevent a person climbing the wall from reaching out and contacting the arcuate elements and the arcuate elements are spaced apart a sufficient distance to prevent a person from passing between adjacent elements.

20 Claims, 6 Drawing Sheets

ASSEMBLY FOR THE TOP OF A SECURITY WALL

CROSS REFERENCE TO RELATED APPLICATIONS

This application is a continuation in part of application Ser. No. 15/932,635, filed Mar. 29, 2018.

STATEMENT REGARDING FEDERALLY SPONSORED RESEARCH OR DEVELOPMENT

Not Applicable

BACKGROUND OF THE INVENTION

High security walls are used to prevent egress or ingress in multiple settings, such as country borders, prison perimeters, high value premises, and related locations. Walls are scaled in several ways, such as being climbed, using ladders, scaling using ropes, grappling hooks, or other inventive means. Walls may be solid, may be spaced apart bars, or a combination of both, or fences surmounted by razor or concertina wire or barbed wire, or a combination of the various elements, or otherwise.

The successes, or the lack thereof, of the prior art walls leave something to be desired. The prior art walls are at best a detriment to ordinary persons having limited resources, but to persons having a great desire to surmount a prior art wall, each of the state of the art walls with their various top elements, if any, are overcome with very little effort. The present invention overcomes the deficiency of the prior art by producing a top element that prohibits a person from going over the top of a wall by use of spaced apart convex/concave elements secured to the top of the wall, regardless of the type of construction of the wall itself.

SUMMARY OF THE INVENTION

This invention comprises a top element assembly having an outwardly and downwardly convex/concave configuration, with continuous or spaced apart elements, for security walls that prevent the scaling of a high security wall by conventional means. The top element assembly extends convexly outwardly downwardly generally perpendicular to the wall from the top of the wall in both "inside" and "outside" directions. A person may scale the wall, but cannot go further because of the concave configuration of the top assembly. The distal ends or portions of the top assembly terminate at a predetermined distance from the surface of the wall, such as six to eight feet. The elements of the top assembly may terminate at a distance from the wall on a radius with respect to the top of the wall, or at a slight return, or on a diminishing radius, as desired. Several embodiments are shown and discussed.

Among the object of the invention are the following:

To provide a new and useful top assembly for a security wall;

To provide a new and useful top assembly for a security wall having a downwardly and outwardly extending configuration;

To provide a new and useful top element for a security wall having a continuous longitudinal convex/concave portion;

To provide a new and useful top assembly for a security wall have a plurality of spaced apart convex/concave elements;

To provide a new and useful top element for a security wall extending outwardly and downwardly from the top of the wall in both directions generally perpendicular to the wall;

To provide a new and useful top assembly for a security wall having elements extending outwardly and downwardly from the wall and terminating at a predetermined distance from the wall;

To provide a new and useful top element assembly for a security wall extending outwardly and downwardly from the wall and terminating in a return portion at less than a maximum distance from the wall;

To provide a new and useful top element for the top of a security wall having a plurality of spaced apart convex/concave elements and each element includes a continuous fixed dimension;

To provide a new and useful top element for the top of a security wall having a plurality of spaced apart convex/concave elements having a varying cross sectional dimensions; and To provide a new and useful top assembly having a double convex/concave assembly, with each convex/concave assembly extending upwardly and outwardly and downwardly and outwardly from a vertical wall portion.

DETAILED DESCRIPTION OF THE INVENTION

Figure 1:
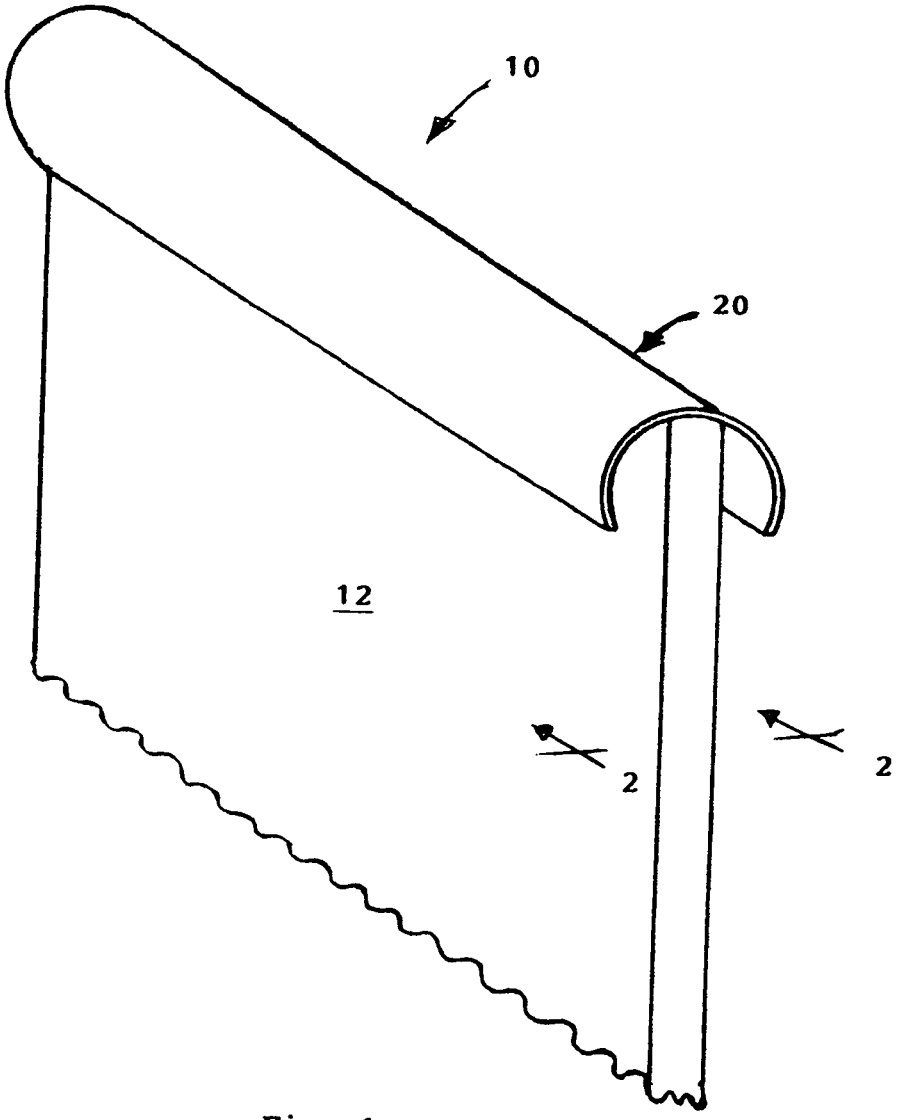
FIG. 1 is a perspective view of a portion of a security wall with the top elements of the present invention in place on the top of the wall.
Figure 2:
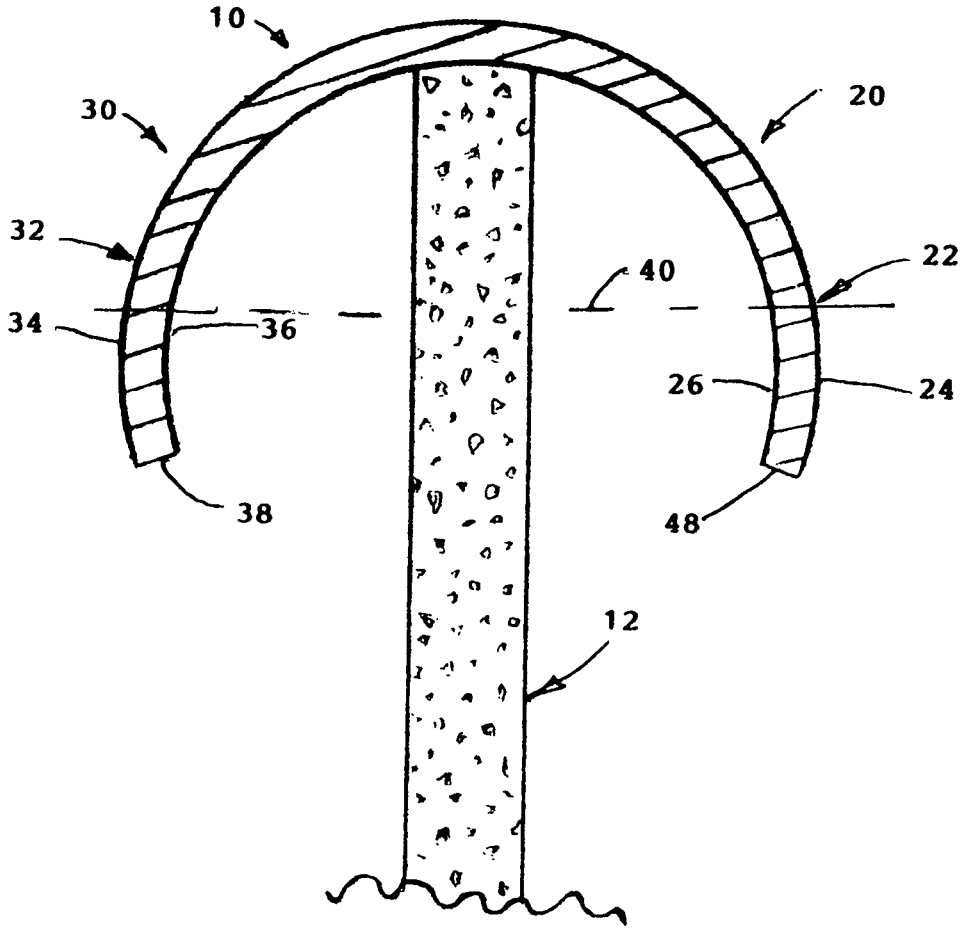
FIG. 2 is a view of the wall of FIG. 1 taken generally along line 2-2 of FIG. 1.

FIG. 1 is a perspective view of a security wall structure 10 with a top element assembly portion 20 secured at the top of the wall 10. FIG. 2 is a side view in partial section of the wall structure 10.

The wall structure 10 includes a vertical portion 12 and a top assembly portion 20. As indicated in FIG. 2, the vertical portion 12 is solid, and the top assembly portion is hatched as metal, such as steel or aluminum, or it may be any appropriate material secured to the vertical portion 20.

As is understood where security issues are paramount, the vertical portion preferably extends upwardly to a height of about thirty feet above the ground. The vertical portion also extends into the ground a sufficient distance to support the entire wall structure.

The top assembly portion 20 includes a curved inside portion 22 and an outside portion 32. The terms "inside" and "outside" refer to the portions of the wall structure relative to the security facet of the wall 10. The inside portion 22 has an outer convex configuration or surface 24 and in inner concave configuration or surface 26. The inside top portion 22 terminates at a distal end 28, and the outside top portion 32 terminates at a distal end 38.

Similarly, the outside portion 32 includes an outer convex configuration or surface 34 and an inner concave surface or portion 36.

Broken line 40 defines the diametrical location of the top portion. It will be noted that the top portion 20 extends arcuately greater than one hundred eighty degrees. The part of the top portion 20 which extends past the one hundred eighty degree portion comprises an arcuate return for the top portion.

The inside and outside portions 22 and 32, respectively, preferably may extend between one hundred forty and one hundred eighty degrees. They may extend lesser or greater, if desired, However, an arcuate extent of greater than one hundred eighty degrees arcuate length may make it easier for a person to get around and over the top of the assembly than a one hundred eighty degree or less arcuate length.

The distal ends 28 and 38 preferably terminate six to eight feet from the vertical wall 12. However, the thickness of the curved top portion 20 and the arcuate lengths and distances or the spacing from the wall may be as desired. The distance should be such that a person attempting to scale the wall could not reach outwardly to the curved portion, or not less than five feet from the wall.

The top assembly portion 20 is shown extending continuously along the top of the vertical portion 12. The portion 20 may also be corrugated or of any appropriate cross sectional configuration, as desired.

Figure 3:
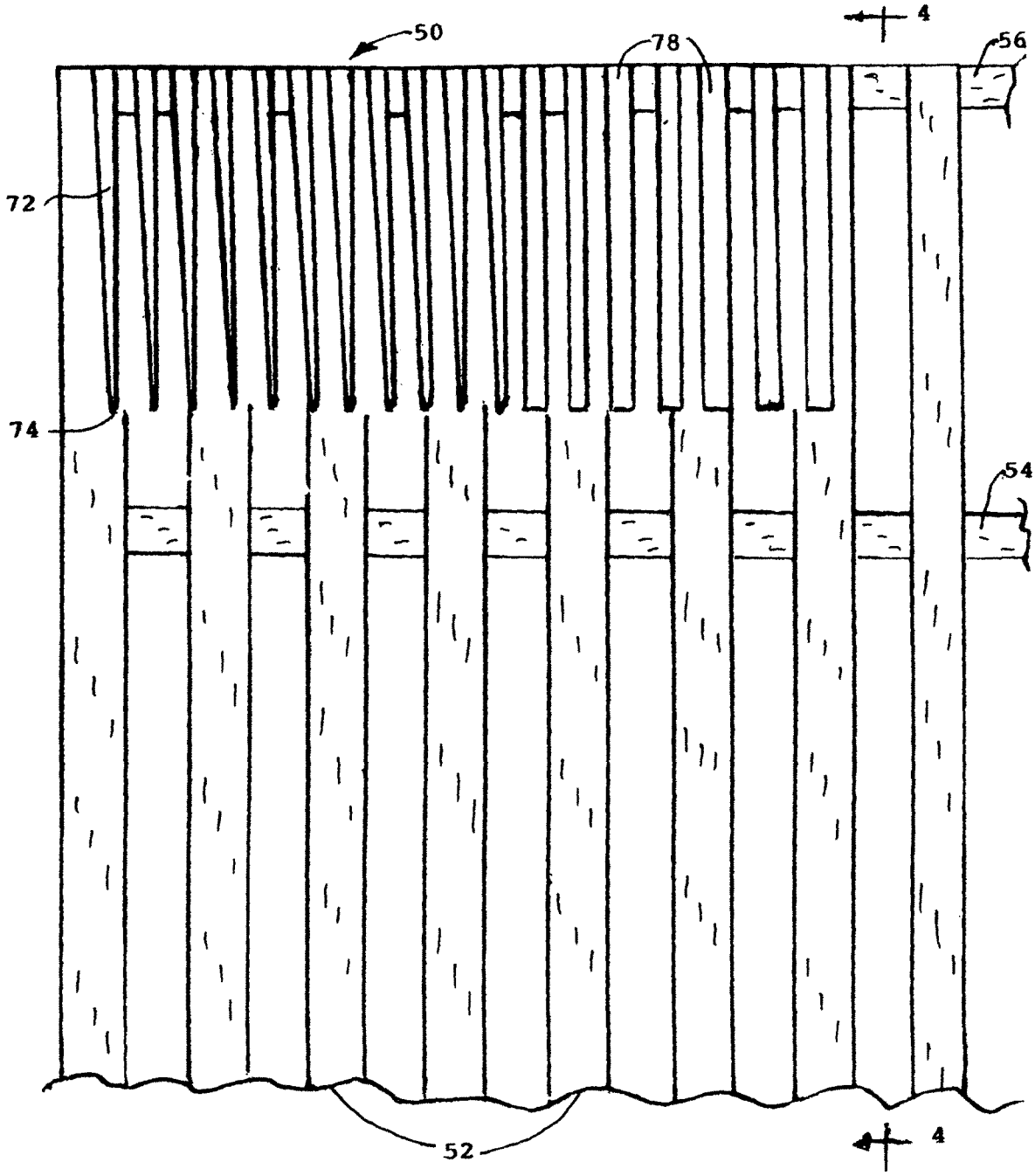
FIG. 3 is a front view of an alternate embodiment of the wall embodiment of FIGS. 1 and 2.

FIG. 3 is a front view of an alternate embodiment of the security wall structure 10 of FIGS. 1 and 2, comprising a security wall structure 50. The security wall structure 50 includes a plurality of longitudinally spaced apart vertical elements 52 secured together by spacer or connector elements 54 and 56. The elements 54 are the middle elements and the elements 56 are the upper elements at the top of the wall 50. The vertical elements 52 define the wall structure as see—through wall, as contrasted with the solid wall 10 of FIGS. 1 and 2.

Figure 4:
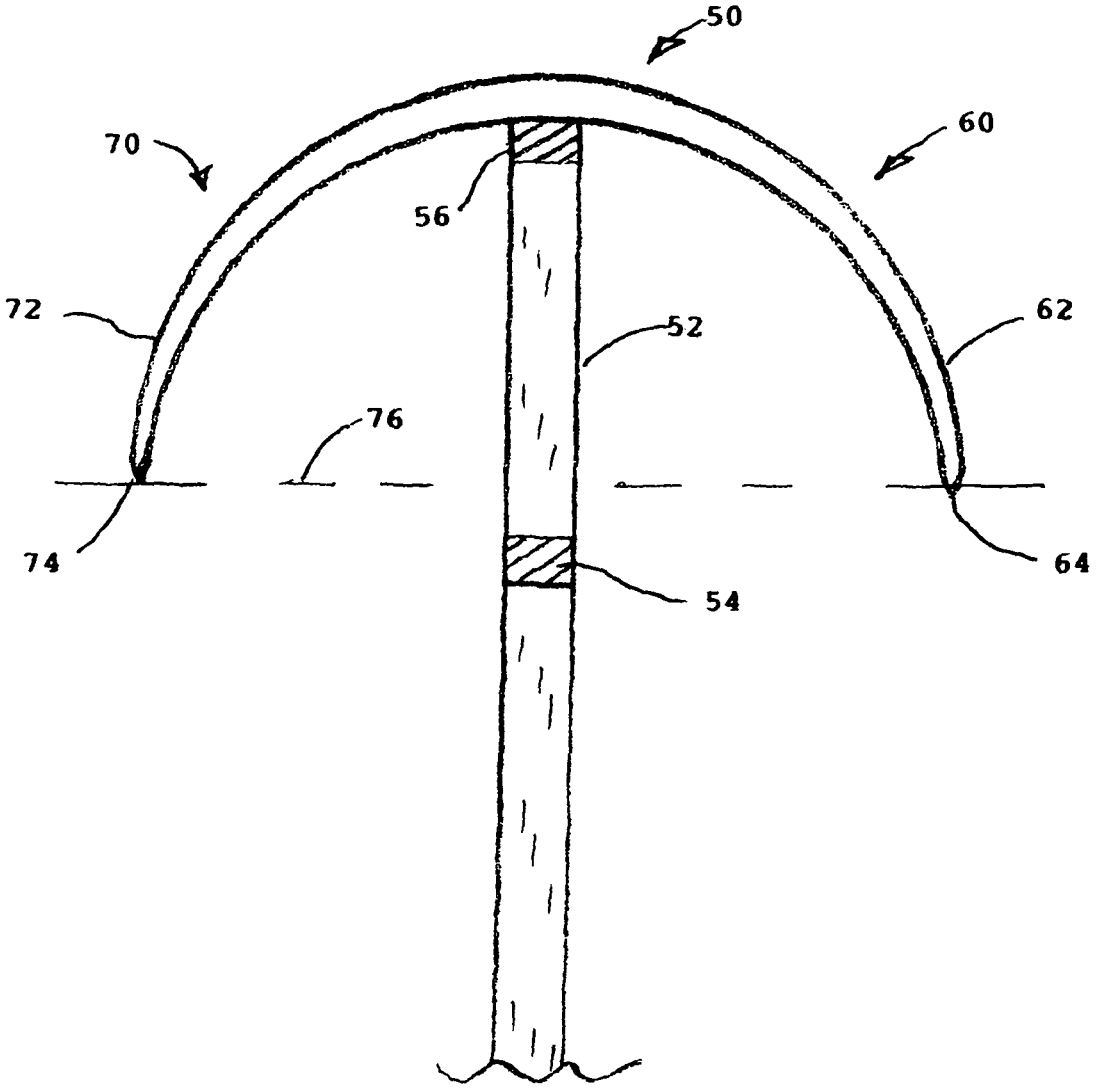
FIG. 4 is an end view of the embodiment of the FIG. 3 taken generally along line 4-4 of FIG. 3.

A plurality of arcuate elements is secured to the top of the vertical elements 52. Two different types of arcuate elements are shown in FIG. 3. FIG. 4 is a side view in partial section of the security wall structure 50 of FIG. 3 taken generally along line 4-4 of FIG. 3. For the following discussion, attention will be directed to both FIGS. 3 and 4.

The arcuate elements shown in FIG. 3 include two types of elements, tapered elements 72 and rectangular elements 78. In FIG. 2, the arcuate element groups include inside elements 60 and outside elements 70. Note that both elements groups 60 and 70 are tapered from a maximum cross sectional area in thickness between the convex and concave surfaces at the top of the wall 50 to a minimum thickness cross sectional area at distal tips. This taper is without regard to whether the arcuate elements are tapered in width as the elements 72, or the rectangular elements 78 of FIG. 3. The arcuate elements may selectively be tapered in width or in thickness or in both width and thickness, or be without taper.

In FIG. 4, the inside element group 60 includes a plurality of tapered elements 62. The elements 62 terminate in distal tips 64. The outside arcuate element group 70 includes a plurality of tapered elements 72. The outside elements 72 terminate at distal tips 74. Again, the distal tips may be spaced apart from the vertical portion of the wall by about six to eight feet, or as desired, or as practical, but at least five feet from the wall to prevent a person scaling the wall from contacting the elements.

Line 76 comprises a one hundred eighty degree line for the arcuate elements 60, 62. That is, the arcuate elements extend only about one hundred eighty degrees, and do not include a return portion, such as shown in FIG. 2.

It will be noted that in FIG. 3, a vertical line for some of the vertical elements have been omitted adjacent to the arcuate elements for purposes of clarity. An additional vertical element 52 is shown without the arcuate elements.

The arcuate length of the top portions 20 of FIGS. 1 and 2 and 60 and 70 of FIGS. 3 and 4 may extend as desired. Moreover, while the arcuate structures are illustrated as being segments of circles, they need not be. They may be circular as shown, or elliptical or other, as desired. Moreover, the cross sectional configuration of the arcuate elements may be square, rectangular, round, elliptical, tapered, or otherwise, as desired. Preferably, the arcuate elements taper from a maximum cross sectional area at the wall to a minimum cross sectional area or to a point at their distal ends or tips. The taper decreases the likelihood of a rope or other flexible element being secured to the arcuate elements.

The top arcuate elements or structures or assemblies shown may be generally categorized as arcuate convex/concave structures, with the vertical wall portion and an arcuate top portion extending outwardly and downwardly from the top of the vertical wall portion.

From FIGS. 2 and 4 it will be obvious that an intruder may scale the vertical portion of the wall, and then may go no further. The arcuate elements give the intruder no where to go!

A combination of solid vertical wall and spaced apart vertical elements may be a preferable security wall structure, with a see-through lower portion and a solid upper portion, surmounted by a convex/concave top assembly. The see-through lower portion may be spaced to allow animal traffic and natural water flow, but prevent people or intruders to pass through.

The surface of the upper portion should be such that it prevents suction cups from adhering to the wall. Ordinary concrete provides such a surface. Such an upper wall portion, and a top assembly of the present invention, with its convex/concave configuration, prevents passage of a person, even if a person were to attain to the top of the vertical solid wall portion, as with the previously shown and discussed embodiments.

Figure 5:
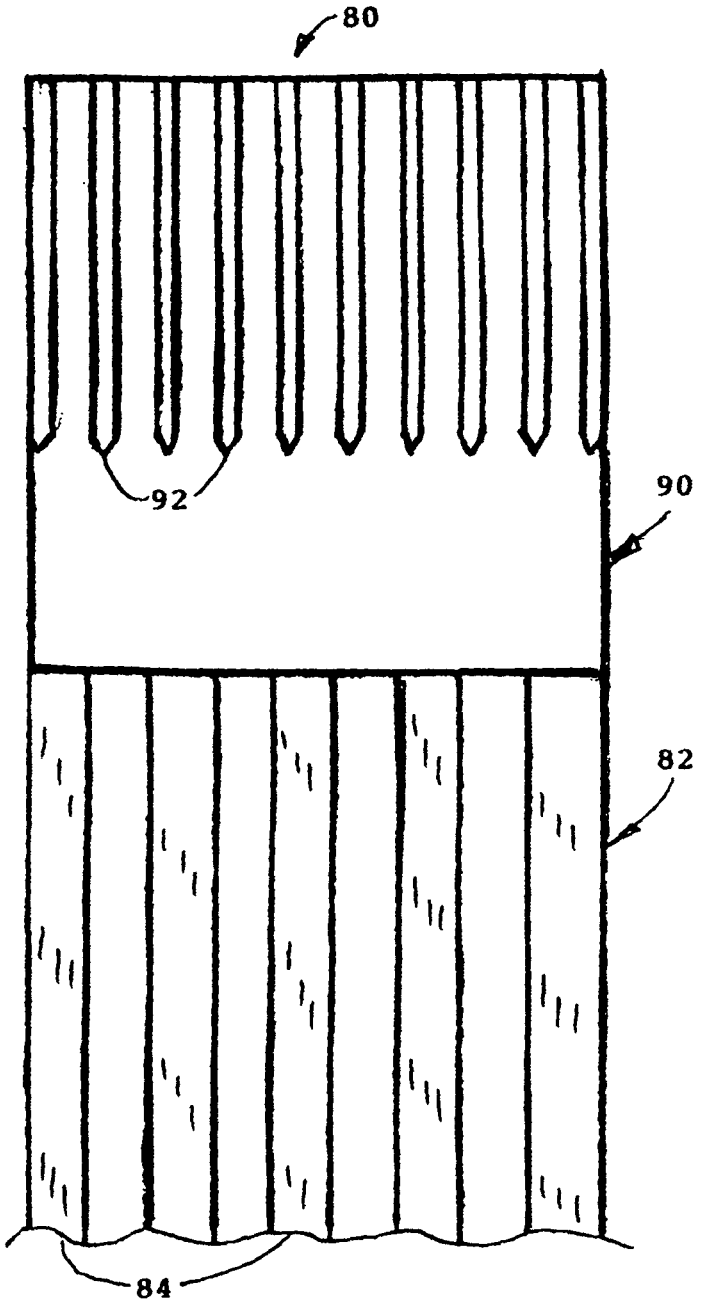
FIG. 5 is a front view an embodiment of the present invention with a combination wall having a see-through lower portion and a solid upper portion and the top assembly elements as shown in FIGS. 3 and 4.

FIG. 5 is a front view of a portion of a wall structure 80. The wall structure 80 is a preferred combination of a see-through lower wall structure 82 and a solid upper wall structure 90. The upper wall structure 90 is not smooth so as to prevent suction elements from adhering to the wall. Ordinary concrete may provide such a surface. The lower see-through structure comprises a plurality of spaced apart vertical elements 84.

A plurality of arcuate top elements 92 is appropriately secured to the upper wall structure 90. The arcuate top elements 92 are convex/concave, as with the previous embodiment of the wall structure 50, and are spaced apart generally between and five and twelve inches.

It will be noted that as stated, the cross sectional configuration of the convex/concave elements may be as desired. The convex/concave elements need not be diametrically aligned, or be evenly spaced. Regardless of the cross sectional configuration, the tapering of arcuate elements has advantages, as discussed above.

Moreover, it will be understood that the term "arcuate" is not limited to the classical meaning of the term, but rather is broad enough to include curves made of straight segments, or any other configuration in accordance with practical construction practices, including offset portions.

It will be noted that the convex/concave top element assemblies of the present invention may be conveniently fabricated in sections remotely and then be transported and attached to the top of virtually any wall structure.

Figure 6:
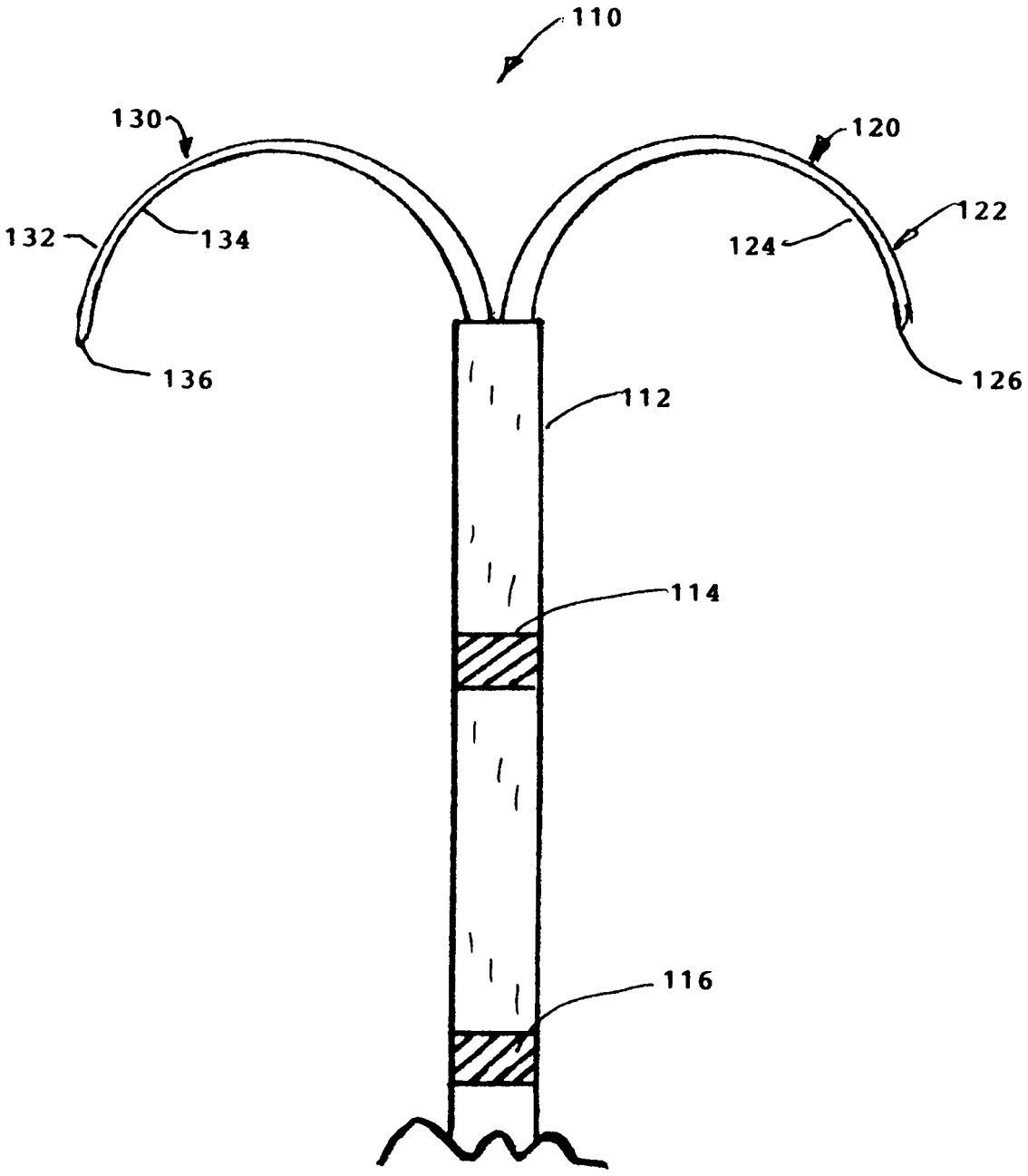
FIG. 6 is an end view of an alternative embodiment of the wall structures of FIGS. 1-5.

FIG. 6 is a side view in partial section of another alternate embodiment security wall structure 110 of the present invention, comprising a top wall portion having a double convex/concave configuration. The security wall structure 110 of FIG. 6 is shown with a see-through vertical wall structure which includes a plurality of spaced apart vertical elements 112. The vertical elements 112 may be comparable to the wall elements 52 of FIGS. 3 and 4 and the vertical elements 84 of FIG. 5. The vertical wall elements 112 include spacers or connectors 114 and 116, which are comparable to the elements 54 of FIGS. 3 and 4.

Appropriately secured to the top of the wall structure 110 are double convex/concave arcuate elements or sections 120 and 130.

The elements 120 and 130 extend arcuately upwardly and outwardly and then downwardly and outwardly in what may be considered as a double arcuate configuration. The double arcuate elements 120 and 130 extend upwardly and outwardly and then downwardly and outwardly from the top of the wall structure 112. The elements 120 and 130 are appropriately secured to the top of the wall structure 112 and terminate outwardly from the top of the vertical wall 112. The elements 120 and 130 are appropriately secured to the wall structure 110 by well known construction techniques.

The convex/concave element 120 is the inside concave/convex element and the convex/concave element 130 is the outside convex/concave element. Each element 120 and 130 is a complete arcuate or semicircular element section by itself. The inside element 120 includes a complete arcuate outside convex surface 122 and a complete arcuate inside concave surface 124. The element 120 terminates in a distal tip portion 126.

The outside element 130 includes a complete outside arcuate convex surface 132 and a complete arcuate inside concave surface 134. The elements 130 terminates at distal tips 136.

The term "complete" in the preceding paragraphs refers to the fact that the convex/concave surfaces 122/124 and 132/134 each extend for about one hundred eighty degrees, or generally semicircular, as discussed above. The assembly 110 comprises a double structure or assembly extending outwardly in both directions from the top center of the vertical wall 112. The arcuate extent of the elements 120 and 130 may be as desired, and is not limited to the suggested semicircular one hundred eighty degrees, but may extend as desired, as discussed above.

As with the convex/concave portions of the wall structure 50, the distal ends 126 and 136 of the elements 120 and 130 are disposed preferably outwardly from the vertical wall portion 82 about six to eight feet, or at a minimum of five feet. The distance may vary from the suggested six to eight feet, as previously stated, but the distance should be such as to make it virtually impossible for a person to reach from the vertical wall to the distal tips of the convex/concave top assembly elements, as stated above for the other embodiments discussed above. Hence the minimum distance of five feet.

Similarly, the spacing of the elements may be as desired. The elements, of course, should be spaced close enough to prevent persons from going between them, or between five and twelve inches. The width of the elements may be as desired, but need not be aligned on a one to one ratio with the width of the vertical wall elements, such as the wall elements 82 of FIG. 5.

It will be noted that the vertical tapering of the elements is shown in FIGS. 2 and 4, but the lateral or side configuration is shown without any taper. Obviously, the elements may be tapered in both directions, or as desired or as practical from a manufacturing perspective. As indicated above, a taper makes the possibility of securing a rope or other material to an element less likely than if the element were rectangular. A double taper, or a round element with a full taper may be the best design.

It will also be understood that the elements may be flat, or virtually any cross sectional configuration, as indicated. Moreover, if the width of the curved elements is sufficiently wide that a person cannot take hold of an element by hand, then even by cupping a hand on the top of the element there is no satisfaction in such cupping a hand on the top of the element because curvature of the elements makes the likelihood of successfully achieving an inversion of a body onto the convex portion of an element virtually impossible, but leaving the intruder dangling in space.

Thus a relatively wide strap-type element may have advantages over other cross sectional configurations, unless the other cross sectional configuration type of elements have a relatively wide portion extending outwardly from the top of the wall for at least a predetermined arcuate distance to prevent hands from grasping the elements.

While the principles of the above described apparatus have been made clear in illustrative embodiments, without departing from those principles there may occur to those skilled in the art modifications of structure, arrangement, proportions, the elements, materials, angular distances, and components used in the practice of the apparatus, and otherwise, which are particularly adapted to specific environments and operative requirements. The appended claims are intended to cover and embrace any and all such modifications within the limits only of the true spirit and scope of the present disclosure.

What I claim is:

1. A security wall assembly comprising in combination:

a security wall having a vertical portion and a top portion;

an inside convex/concave element secured to the top portion and extending arcuately upwardly and outwardly and downwardly and outwardly from the top portion;

the inside convex/concave element terminates in a distal end at a predetermined distance from the security wall;

an outside convex/concave element secured to the top portion adjacent to the inside convex/concave element and extending arcuately upwardly and outwardly and downwardly and outwardly; and the outside element terminates at least five feet from the vertical portion to prevent a person scaling the wall from contacting the distal end.

2. The assembly of claim 1 in which the inside and outside elements taper from a maximum cross sectional area at the top portion of the security wall to a minimum cross sectional area at their distal ends.

3. The assembly of claim 2 which includes a plurality of inside and outside elements spaced apart from five to twelve inches from each other on the top portion of the security wall.

4. The assembly of claim 3 in which the distal ends of the plurality of inside and outside elements comprise pointed tips.

5. An assembly for the top of a security wall comprising in combination:

a security wall having a vertical portion and a top portion;

a first plurality of elements secured to and extending outwardly and downwardly from the top portion of the security wall, and each element of the plurality of elements includes a convex surface and a concave surface;

a second plurality of elements secured to and extending outwardly and downwardly from the top portion of the security wall and generally oppositely from the first plurality of elements, and each element of the second plurality of elements includes a convex surface and a concave surface; and each element of the first and second plurality of elements terminates in a distal end at at least five feet outwardly from the vertical portion of the security wall to prevent a person scaling the wall from contacting the distal ends.

6. The assembly of claim 5 in which the first and second pluralities of elements extend longitudinally along the security wall.

7. The assembly of claim 6 in which the first and second pluralities of elements extend arcuately from one hundred forty degrees to one hundred eighty degrees.

8. The assembly of claim 6 in which the elements of the first and second pluralities of elements extend arcuately greater than one hundred and eighty degrees.

9. The assembly of claim 6 in which the plurality of first elements are tapered from the security wall outwardly and downwardly to their distal ends.

10. The assembly of claim 9 in which the plurality of second elements are tapered from the security wall outwardly and downwardly to their distal ends.

11. The assembly of claim 5 in which the elements of the first plurality of elements are spaced longitudinally along the security wall, each element of which is at a predetermined distance of between five and twelve inches from adjacent elements to prevent the passage of a person between adjacent elements of the plurality of first elements.

12. The assembly of claim 11 in which the elements of the second plurality of elements are spaced apart longitudinally along the security wall generally oppositely from the plurality of elements of the first plurality of elements, and each element of which is a predetermined distance of from five to twelve inches from adjacent elements of the second plurality of elements to prevent the passage of a person between adjacent elements of the second plurality of elements.

13. The assembly of claim 12 in which the of elements of the first and second pluralities of elements extend arcuately less than one hundred eighty degrees.

14. The assembly of claim 12 in which the elements of the first and second pluralities of elements extend arcuately greater than one hundred eighty degrees.

15. The assembly of claim 12 in which the plurality of elements of the first plurality of elements selectively taper in width or in thickness or both from the wall outwardly and downwardly to terminate in tips at their distal ends.

16. The assembly of claim 15 in which the plurality of elements of the second plurality of elements selectively taper in width or in thickness or both from the wall outwardly and downwardly to terminate in tips at their distal ends.

17. An assembly for the top of a security wall comprising in combination:

a security wall having a vertical portion and a top portion;

a first convex element secured to the top portion or the security wall having a concave interior portion, and the first convex element extends outwardly and downwardly from the top portion of the security wall and terminates in a first distal end at least five feet from the vertical portion of the security wall;

a second convex element secured to the top portion of the security wall having a concave interior portion, and the second convex element extends outwardly and downwardly from the top portion of the security wall and terminates in a second distal end at least five feet from the vertical portion of the security wall;

the first and second convex elements are generally parallel to and spaced apart from each other at a predetermined distance;

a third convex element secured to and extending outwardly and downwardly from the top portion of the security wall generally oppositely from the first convex element;

a fourth convex element secured to and extending outwardly and downwardly from the top portion of the security wall generally oppositely from the second convex element; and the first and second convex elements are spaced apart not greater than twelve inches.

18. The assembly of claim 17 in which the first and second convex elements extend longitudinally along the security wall generally parallel to each other.

19. The assembly of claim 17 in which the first and second elements are tapered from a maximum cross sectional area at the top portion of the security wall to a minimum cross sectional area at their distal ends.

20. The assembly of claim 17 in which the third and fourth elements are tapered from a maximum cross sectional area at the top of the security wall to a minimum cross sectional area at their distal ends.

* * * * *